US009218795B1

(12) United States Patent
Woolery et al.

(10) Patent No.: US 9,218,795 B1
(45) Date of Patent: Dec. 22, 2015

(54) STRINGED INSTRUMENT TUNING DEVICE

(71) Applicants: William Woolery, Interlaken, NY (US); David J. Borisoff, Interlaken, NY (US)

(72) Inventors: William Woolery, Interlaken, NY (US); David J. Borisoff, Interlaken, NY (US)

( * ) Notice: Subject to any disclaimer, the term of this patent is extended or adjusted under 35 U.S.C. 154(b) by 195 days.

(21) Appl. No.: 13/735,653

(22) Filed: Jan. 7, 2013

Related U.S. Application Data

(60) Provisional application No. 61/631,605, filed on Jan. 9, 2012.

(51) Int. Cl.

| | |
|---|---|
| ***G10D 3/14*** | (2006.01) |
| ***G10D 3/00*** | (2006.01) |
| ***G10C 3/10*** | (2006.01) |
| ***G10D 1/00*** | (2006.01) |
| ***G10D 3/08*** | (2006.01) |

(52) U.S. Cl.
CPC ..... *G10D 3/143* (2013.01); *G10C 3/10* (2013.01); *G10D 1/00* (2013.01); *G10D 3/08* (2013.01); *G10D 3/14* (2013.01); *G10D 3/146* (2013.01)

(58) Field of Classification Search
CPC ..... G10D 3/143; G10D 3/14; G10D 3/146; G10D 1/00; G10C 3/08; G10C 3/10
USPC ..... 84/312 R, 313, 297 R, 298, 299, 304, 84/312 P; 984/119, 120, 121
See application file for complete search history.

(56) References Cited

U.S. PATENT DOCUMENTS

| | | | | | |
|---|---|---|---|---|---|
| 2,603,119 | A * | 7/1952 | Dearth | 84/312 R |
| 2,641,152 | A * | 6/1953 | Hise | 84/312 R |
| 2,644,360 | A * | 7/1953 | Smith | 84/312 R |
| 2,654,283 | A * | 10/1953 | Barr | 84/312 R |
| 3,319,502 | A * | 5/1967 | Hackney | 84/173 |
| 3,674,909 | A * | 7/1972 | Peters et al. | 84/312 R |
| 4,080,865 | A * | 3/1978 | Gfell | 84/312 R |
| 4,106,387 | A * | 8/1978 | Alifano | 84/312 P |
| 4,535,670 | A * | 8/1985 | Borisoff | 84/312 R |
| 4,610,190 | A * | 9/1986 | Maloney | 84/312 R |
| 4,632,005 | A * | 12/1986 | Steinberger | 84/313 |
| 4,643,069 | A * | 2/1987 | Borisoff et al. | 84/306 |
| 4,686,883 | A * | 8/1987 | Piche et al. | 84/313 |
| 4,811,645 | A * | 3/1989 | Cummings | 84/207 |
| 4,928,564 | A * | 5/1990 | Borisoff et al. | 84/313 |
| 5,140,884 | A * | 8/1992 | Bowden | 84/312 R |
| 5,438,902 | A * | 8/1995 | Baker | 84/312 R |
| 5,542,330 | A * | 8/1996 | Borisoff | 84/298 |
| 5,739,444 | A * | 4/1998 | Borisoff | 84/291 |
| 5,760,321 | A * | 6/1998 | Seabert | 84/312 R |
| 6,015,945 | A * | 1/2000 | Borisoff | 84/313 |
| 6,972,360 | B1 * | 12/2005 | Ekin | 84/312 R |
| 7,183,475 | B2 * | 2/2007 | Van Halen | 84/312 R |
| 8,017,844 | B2 * | 9/2011 | Steinberger | 84/298 |
| 2006/0037459 | A1 * | 2/2006 | Skinn et al. | 84/312 R |

(Continued)

*Primary Examiner* — David Warren
*Assistant Examiner* — Christina Schreiber
(74) *Attorney, Agent, or Firm* — Saul Epstein

(57) ABSTRACT

A device for setting the tension in a string of a stringed musical instrument whereby a musician can instantly retune the string to play either one of two predetermined notes by merely actuating a lever. The device is preferably attached between the tailpiece or body of the instrument and an end of the string. The element of the tuner to which the string is attached (a string anchor) moves with a rectilinear motion to change the string tension. Two embodiments are disclosed, one of which used a rotating cam to position the string anchor, and the other of which uses a two-bar linkage to position the string anchor.

24 Claims, 6 Drawing Sheets

(56) References Cited

U.S. PATENT DOCUMENTS

2008/0229900 A1* 9/2008 Steinberger ..... 84/313
2011/0011238 A1* 1/2011 Toone ..... 84/297 S
2012/0318117 A1* 12/2012 Deck ..... 84/313

* cited by examiner

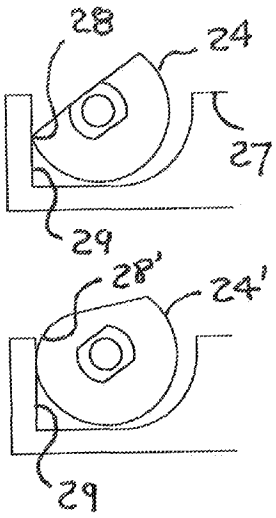
Fig 4A
Fig 4B
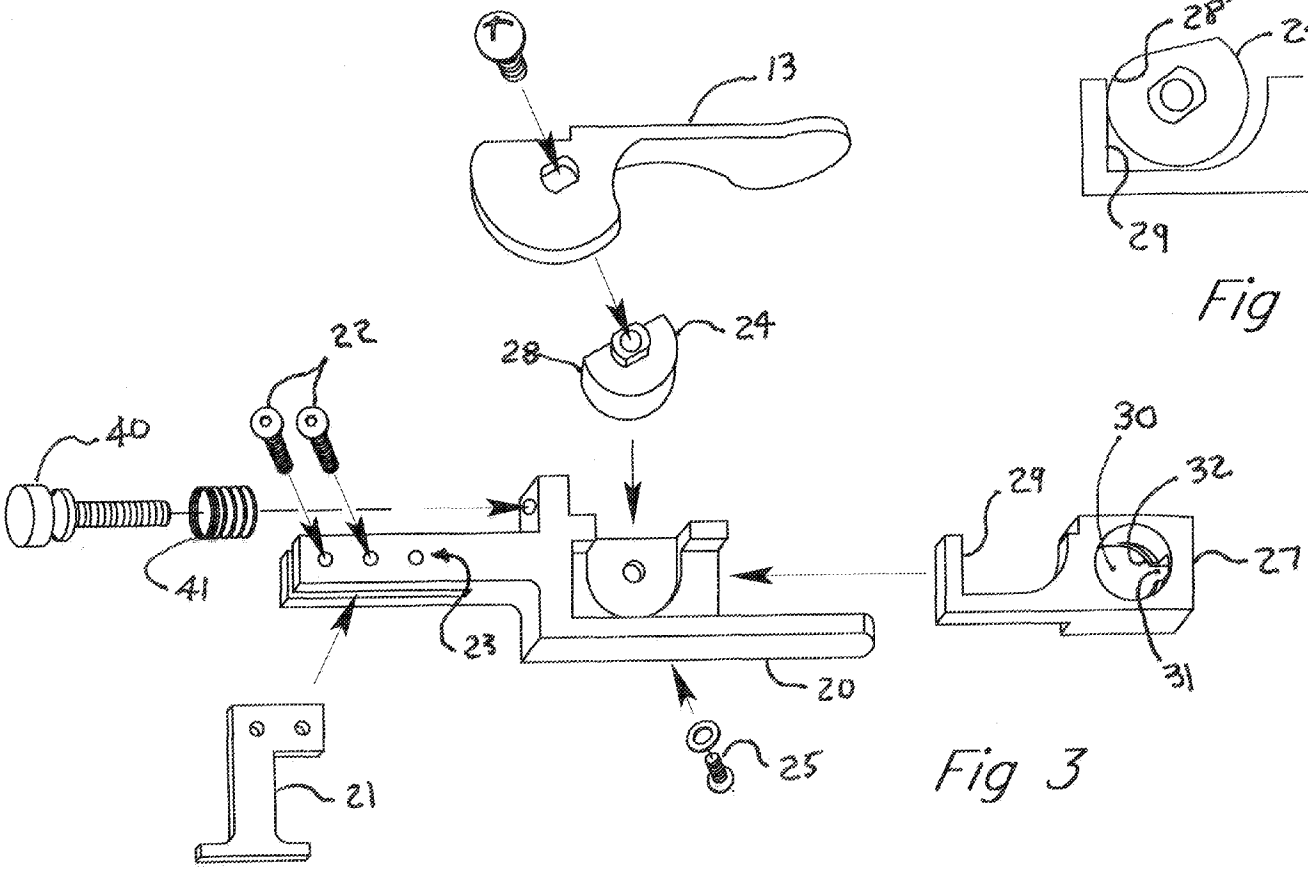
Fig 3

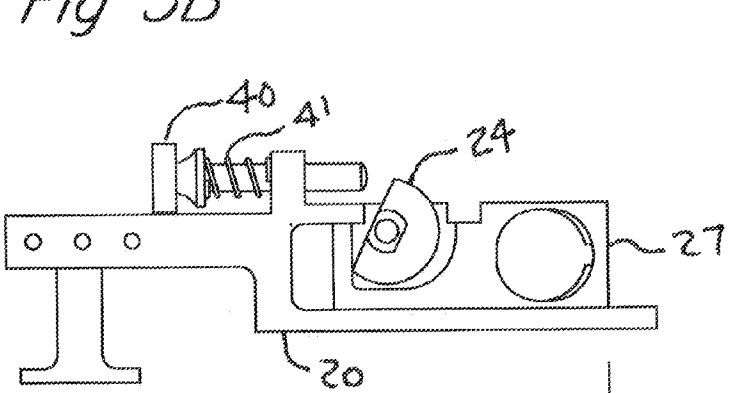
Fig 5B
Fig 5A
Fig 6B
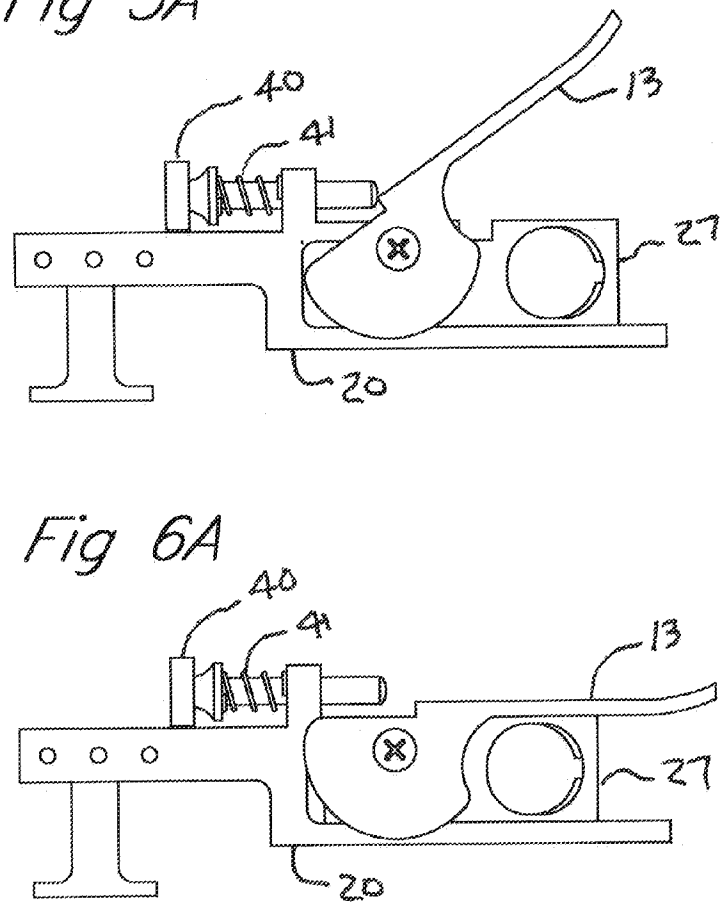
Fig 6A

STRINGED INSTRUMENT TUNING DEVICE

RELATED APPLICATIONS

This application claims the benefit under 35 USC §119(e) of the filing date of U.S. Provisional Patent Application Ser. No. 61/631,605, entitled "Musical Instrument Retuning Device" filed on Jan. 9, 2012. By this reference, the contents of Application Ser. No. 61/631,605 are incorporated herein in their entirety.

BACKGROUND OF THE INVENTION

Music, as composed and played in the western world, is almost universally based on the use of harmonically related notes, i.e., the notes are selected from groups of notes, the frequencies of which groups differ from each other by factors of two, i.e., an octave. The individual notes within each octave (in the western world) are commonly defined by a twelve-tone equal-tempered scale. In this scale, the adjacent notes are related by the twelfth root of two, and alternate notes are named C, D, E, F, G, A, and B (with C being the lowest note). The semi-tones between are termed "sharp" or "flat". Conventionally, the octaves are numbered (1, 2, 3, etc.) such that the note A4 has a frequency of 440 Hz.

Stringed musical instruments, such as the upright bass, viola, violin, guitar, etc. each include a specified number of stretched strings, each of which produces one of the desired notes. The note produced by a particular string depends on a number of factors, including the mass of the string, its length, and the tension in the string. Different instruments are designed to produce particular notes. An upright bass, for example, usually has four strings, tuned to produce the notes E1, A1, D2, and G2. Other instruments have the same or a different number of strings, generally tuned to provide specific notes as appropriate to the type of instrument.

While instruments that are tuned in the historically customary manner can, and do, provide much pleasing music, sometimes a musician may wish that his or her instrument is capable of playing other notes. For example, if an upright bass player were able (during a performance) to retune the low E1 note to D1, more harmonic variations would be possible, which could enhance the musical performance. Or, if the upright bass tuning could be instantly changed to fifths (C1, G1, D2, A2—cello tuning for bass) from the standard fourths tuning (E1, A1, D2, G2—standard bass tuning), the instrument would have substantially increased versatility.

There have been a number of attempts to produce devices that provide the foregoing functionality, but they generally have not been completely satisfactory. In many cases, it has not been easy or convenient to switch from one tuning to another during a performance, so that the advantage of the extra notes potentially available has not been easily accessible. In other cases, significant modification of the basic instrument is required, which is resisted by most musicians. Other problems have also arisen.

SUMMARY OF THE INVENTION

While the present invention has applicability to any stringed instrument (acoustic or electric), for purposes of convenience and ease of presentation, the invention is described here primarily as being applied to an acoustic upright bass. The physical size of various stringed musical instruments varies substantially, so it will be understood that, similarly, the physical size and other construction details of embodiments of the invention may vary.

In one presently preferred embodiment of the invention, the invented device can be thought of as part of the string assembly. In this embodiment, a string with one of the invented tuners attached to one end is hooked onto the instrument tailpiece, passed over the bridge, stretched along the instrument neck, and wrapped around the post of a tuning machine at the far end of the instrument neck. Actuating a lever on the invented tuner changes the length of the tuner by a predetermined amount, and thereby changes the tension in the string, and correspondingly its natural frequency. Each tuner changes the frequency at which one string vibrates; by installing an invented tuner at the end of each string, the tuning of any or all strings of an instrument may be changed by the musician, even during a performance.

BRIEF DESCRIPTION OF THE DRAWINGS

FIG. 2A shows the tuner set to its high pitch position, and FIG. 2B shows its low pitch position.

FIG. 3 is an exploded view of one embodiment of the invented tuner.

FIG. 4A is a detail view of one form of cam that may be used in connection with the invention.

FIG. 4B is a detail view of a second form of cam that may be used in connection with the invention.

FIG. 5 is a right side view of one embodiment of the invention, the tuner being shown in its low pitch condition. FIG. 5A is a complete tuner, while FIG. 5B shows the tuner as in FIG. 5A, with the actuating lever removed.

FIG. 6 is a right side view of the embodiment of the invention as shown in FIG. 5, the tuner being shown in its high pitch condition. FIG. 6A is a complete tuner, while FIG. 6B shows the tuner of FIG. 6A with the actuating lever removed.

DETAILED DESCRIPTION OF THE INVENTION

Figure 1:
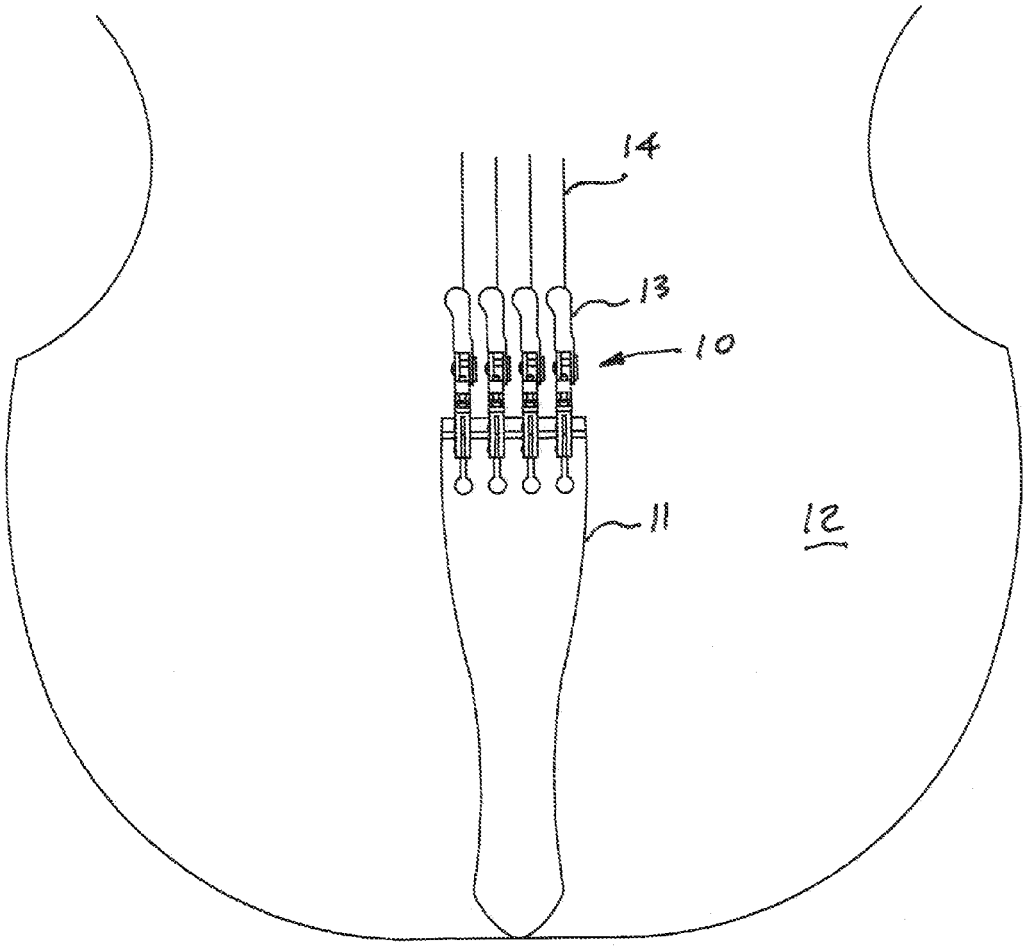
FIG. 1 depicts a plan view of a portion of the body of an acoustic upright bass musical instrument with four of the invented tuners installed thereon.

FIG. 1 shows four tuners 10 according to one embodiment of the invention, each with a string 14 attached, and each hooked onto the tailpiece 11 of an acoustic upright bass musical instrument 12. This installation permits all four of the strings of the instrument to be instantly tuned, each to produce one of two preset tones. The actuating lever 13 of each tuner is individually accessible to change the tension of the corresponding string 14, and thereby its tuning. The ability of a tuner to be attached to and removed from an instrument without using tools is referred to herein as being "removable" or "removably attached".

Figure 2A:
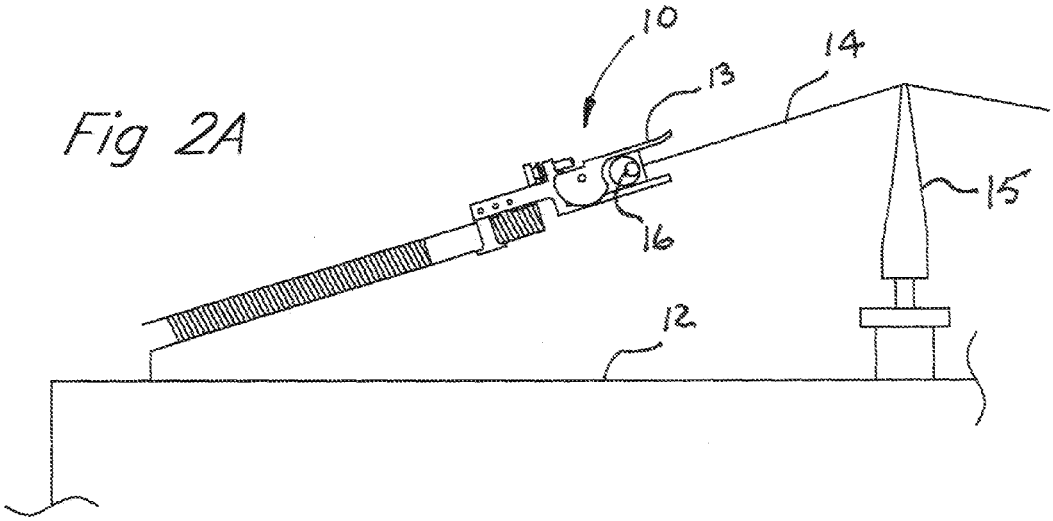
FIGS. 2A and 2B each depict a right side view of one of the invented tuners as installed on the instrument shown in FIG. 1.
Figure 2B:
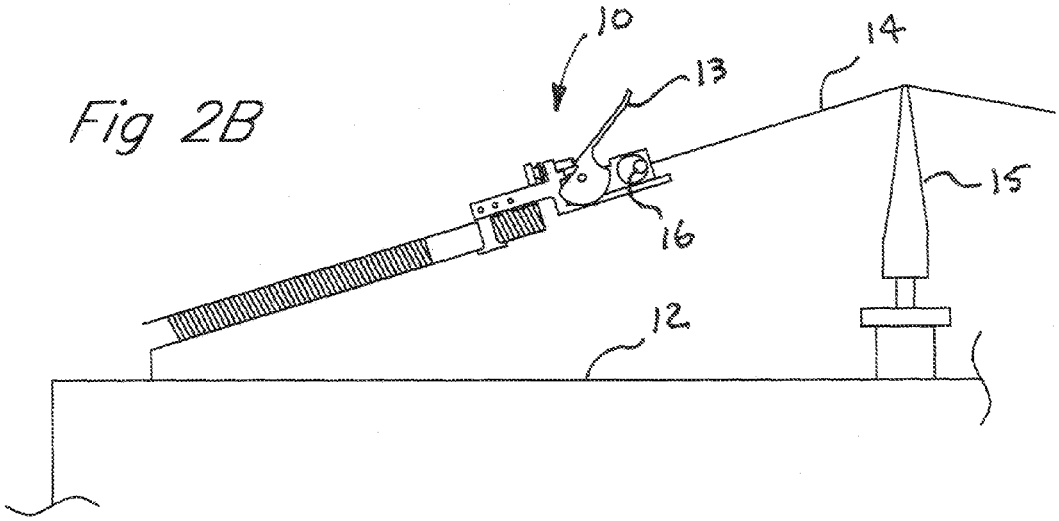

FIGS. 2A and 2B each show a right side view of the installation for one of the strings shown in FIG. 1, where FIG. 2A shows the actuating lever 13 in its high pitch position, and FIG. 2B shows the actuating lever 13 in its low pitch position. Also seen (in both FIG. 2A and FIG. 2B) are the bridge 15 and string 14. Each string 14 has a "ball" 16 attached to its end, as is customary in stringed musical instruments. The ball 16, instead of being attached to the tailpiece of the instrument, as is the usual case, is attached to the invented tuner, i.e., to string anchor 27, as will be described later.

FIG. 3 is an exploded view of one embodiment of the invention where a base member 20 is seen having a hook 21 which is fastened thereto by screws 22. Three holes 23 are preferably provided in the base member tail, which allows the hook to be installed in more than one location, as might be convenient for installation on different instruments. The hook 21 is intended to hook over the tailpiece of the instrument in place of the string ball that ordinarily is in that position. The base member 20 carries a rotatable cam 24, which is secured to the base member by screw 25. The cam 24 is rotated, at the will of the musician, by actuating lever 13.

A portion of string anchor 27 passes between base member 20 and rotatable cam 24 and further includes surface 29 on which cam surface 28 rides. Tension in the string 14 causes string anchor 27 to move substantially rectilinearly as the positioning means (cam 24) is rotated. The string anchor includes an opening 30, into which the ball 16 is inserted; the string exits the string anchor through slot 31. A ridge 32 is preferably provided at the edge of opening 30 to keep the ball from sliding out of the opening.

While not essential, it is preferred that a small amount of lubricant, such as white lithium grease, be placed between the string and the bridge to aid in the smooth operation of the tuner.

The position of string anchor 27 with respect to base member 20 is determined by the position of cam 24. As seen in FIG. 5 (the low pitch position), the string anchor is in its furthest right position (with respect to the drawings). As seen in the drawings, this corresponds to the actuating lever 13 "up" position. Conversely, in FIG. 6 (the high pitch position), the actuating lever, in its "down" position, can be seen to correspond to the string anchor being in its furthest left position. The changes in string anchor position are brought about by the cam surface 28 acting on follower surface 29 (as can be seen in FIG. 4). Tension in the string causes the follower surface 29 to always be in contact with the cam 24. In the drawings, the cam surface 28 appears sharp, but in practice, it is preferably somewhat rounded.

The invented tuner is intended to provide a musician with the capability of instantly retuning a string of a musical instrument to provide one of two notes, one (the high pitch) corresponding to positioning the actuating lever 13 "down", i.e., against string anchor 27, and the second (the low pitch) corresponding to positioning the actuating lever 13 "up", where its motion is limited by the adjusting screw 40. As seen in FIGS. 6A and 6B, the tuner is shown in its high pitch position, with lever 13 pushed down as far as it will go. In FIGS. 5A and 5B, the tuner is set to its low pitch position, where the upward position of actuating lever 13 (and thereby the location of string anchor 27) is limited by adjusting screw 40.

When in the high pitch position, the note that a particular string will provide is preferably set by adjusting the instrument's tuning machine at the end of the neck. The low pitch for that string is then set by adjustment of adjusting screw 40. A spring 41 is preferably provided to avoid the problems that might arise due to vibration when the instrument is played.

Figure 7:
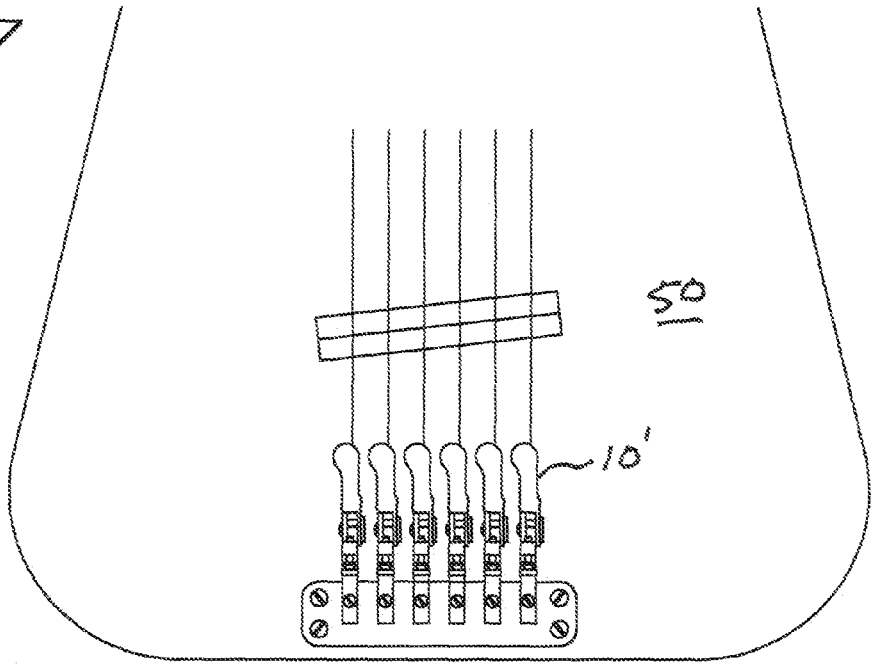
FIG. 7 is a plan view of six instances of the invented tuner as mounted on a guitar.
Figure 8:
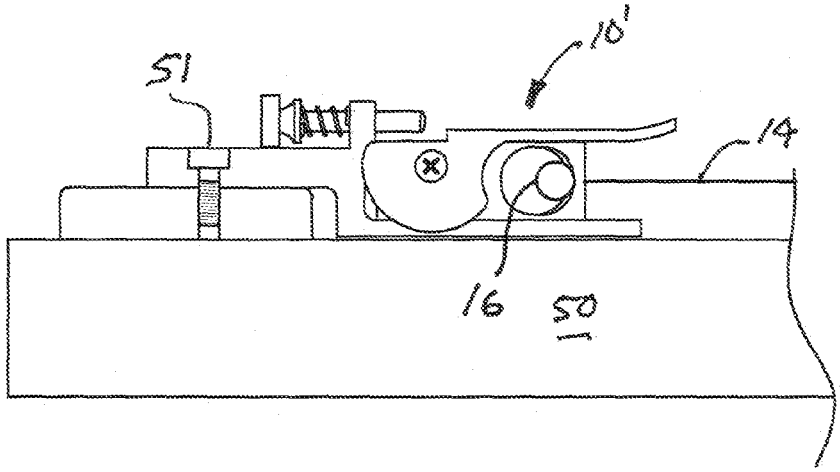
FIG. 8 is a right side view of one of the tuners of FIG. 7.

FIG. 4B illustrates a slightly different shaped cam 24', including a more gently curved cam surface 28'. Other modifications and embodiments of the present invention are possible within the spirit of the claims, such as (but not limited to) other methods for fastening the tuner to the musical instrument, as by using screws or other known fastening methods, instead of the hook shown in the embodiment of FIGS. 1-6. For example, FIG. 7 depicts six instances of an embodiment of the invention (10') fastened to the body 50 of a guitar using screws (51). FIG. 8 is a right side view of the embodiment shown in FIG. 7. All such modifications as fall within the claims, including equivalents thereto, are intended to be covered hereby.

Figure 9:
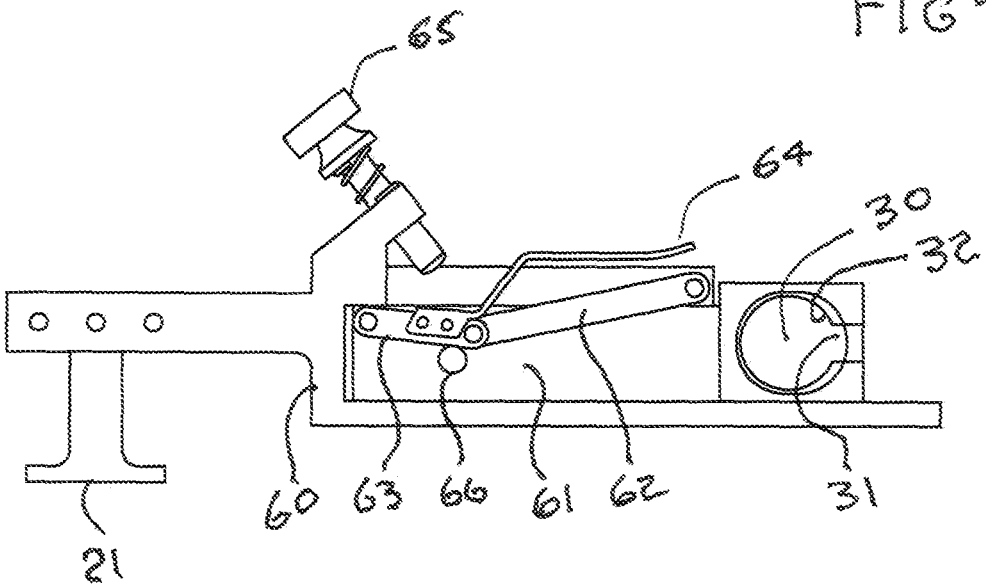
FIG. 9 is a right side view of a second embodiment of the invention, shown in its high pitch condition.
Figure 10:
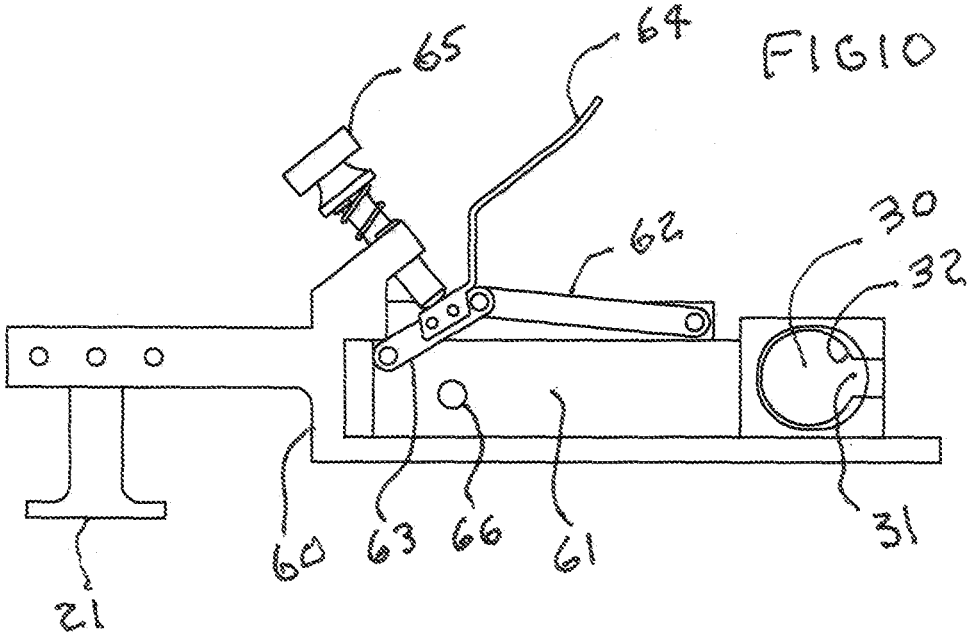
FIG. 10 is a right side view of a second embodiment of the invention, shown in its low pitch condition.

FIGS. 9 and 10 depict a second embodiment of the invention wherein a different positioner construction is used. In this embodiment, a two-bar toggle linkage is utilized to position the string anchor with respect to the base member. An "over-center" toggle, as shown, is preferred, but a two-bar linkage, without the over-center feature could also be used. As seen in FIGS. 9 and 10, the base member 60 can be seen equipped with a hook 21 for engaging the instrument tailpiece, just as the first embodiment. A string anchor 61 includes an opening 30, a retaining ridge 32 and slot 31 (to accept a string and ball), as in the first embodiment. Instead of a cam to control the position of the string anchor, this embodiment uses a two-bar linkage (62, 63). When actuating lever 64 is in its down position (FIG. 9), the bar 63 rests against stop 66, limiting the motion of string anchor 61 (which is being pulled to the right by string tension). When actuating lever 64 is in the up position (FIG. 10) string tension drives link 63 against adjusting screw 65, which sets screw anchor position in the low pitch position.

Tuning of the second embodiment is the same as for the first embodiment. First, the desired high pitch note is set by using the tuning machines or pegs at the end of the neck, and then the desired low pitch note is set by adjusting screw 65.

We claim:

1. A tuning device for a musical instrument of the type having a body, an elongated neck, and at least one tensioned string disposed along said neck, which comprises:

a base member attachable directly or indirectly to the body of said musical instrument;

a string anchor configured to receive and retain one of said at least one tensioned strings, said string anchor being slidably mounted to said base member for substantially rectilinear motion with respect to said base member; and a positioner for said string anchor mounted on said base member and coupled to said string anchor, said positioner being configured to position said string anchor at either one of two preset positions.

2. A tuning device as recited in claim 1 and further including a hook piece attached to said base member for hooking to a tailpiece on said instrument.

3. A tuning device as recited in claim 1 wherein said positioner includes a rotatable cam and a user accessible lever.

4. A tuning device as recited in claim 3 wherein said rotatable cam can be rotated by a user between two preset cam positions, said two preset cam positions corresponding to said two preset string anchor positions.

5. A tuning device as recited in claim 4 where one of said preset string anchor positions is adjustable.

6. A tuning device as recited in claim 5 and further including a screw for setting said one of said preset string anchor positions.

7. A tuning device as recited in claim 1 wherein said positioner includes a two-bar linkage.

8. A tuning device as recited in claim 7 wherein said two-bar linkage is of the over-center type.

9. A tuning device as recited in claim 8 wherein said two-bar linkage has two stable positions, and said tuning device includes a user accessible lever to switch said two-bar linkage between said stable positions.

10. A tuning device as recited in claim 9 wherein one of said stable positions is user settable.

11. A tuning device as recited in claim 10 and further including a screw to set said one of said stable positions.

12. A tuning device for a stringed musical instrument, said instrument having a body and at least one tensioned string, said tensioned string including a string ball attached to one end, which comprises;

a base member attachable to said body of said stringed musical instrument;

a string anchor attachable to said string ball at said one end of said at least one tensioned string of said instrument; and a string anchor positioner coupled to said base member configured to move said string anchor between two preset positions, said string anchor moving between said two preset positions with a substantially rectilinear motion.

13. A tuning device as recited in claim 12 wherein said musical instrument further includes a tailpiece, and wherein said tuning device further includes a hook piece attached to said base member for coupling said base member to said tailpiece.

14. A tuning device as recited in claim 12 wherein said string anchor positioner includes a rotatable cam.

15. A tuning device as recited in claim 14 wherein the distance between said two preset positions is adjustable.

16. A tuning device as recited in claim 15 where said distance is adjusted by means of a screw.

17. A tuning device as recited in claim 12 wherein said string anchor positioner includes a two-bar linkage.

18. A tuning device as recited in claim 17 and further configured to adjust the distance between said two preset positions.

19. A tuning device for a stringed musical instrument, said instrument having a body, a tailpiece attached to said body, and at least one tensioned string, said tuning device being configured to be suspended between said tailpiece and said tensioned string, which comprises:

a base member removably coupled directly or indirectly to said tailpiece;

a string anchor configured to receive said at least one tensioned string; and a positioner for said string anchor mounted to said base member and coupled to said string anchor, said positioner being configured to position said string anchor at either one of two preset positions with respect to said base member.

20. A tuning device as recited in claim 19 and further including a hook piece attached to said base member for coupling said base member to said tailpiece.

21. A tuning device as recited in claim 19 wherein said at least one tensioned string includes a string ball attached to the end of said string.

22. An attachment for changing the tension in a string of a musical instrument of the type having a body, a tailpiece attached to said body, and at least one tensioned string, wherein said attachment is configured to be removably attached to said tailpiece, and said attachment is suspended between said tailpiece and said at least one tensioned string, said attachment comprising;

a base member configured for removable attachment directly or indirectly to said tailpiece;

a string anchor configured to receive said at least one tensioned string; and a user actuatable positioner configured to position said string anchor in either one of two preset positions with respect to said base member.

23. A tuning device as recited in claim 22 and further including a hook piece attached to said base member for coupling said base member to said tailpiece.

24. A tuning device as recited in claim 22 wherein said at least one tensioned string includes a string ball attached to the end of said string.

* * * * *